United States Patent [19]

Mayr et al.

[11] 3,945,106

[45] Mar. 23, 1976

[54] METHOD OF MOUNTING A NATURAL DRAFT COOLING TOWER

[75] Inventors: Günter Mayr, Stuttgart; Jörg Schlaich, Stetten, both of Germany

[73] Assignee: Balcke-Dürr Aktiengesellschaft, Ratingen, Germany

[22] Filed: Nov. 13, 1973

[21] Appl. No.: 415,570

[30] Foreign Application Priority Data

Nov. 15, 1972 Germany ..... 2255793

[52] U.S. Cl. ..... 29/429; 29/428; 52/741; 52/745; 135/1 D; 135/3 C; 135/DIG. 8

[51] Int. Cl.[2] ..... E04B 1/00

[58] Field of Search ..... 29/429, 428; 52/741, 745; 135/1 R, 1 D, 3 R, 3 C, 3 E, 4, 5 B, DIG. 8

[56] References Cited

UNITED STATES PATENTS

| | | | |
|---|---|---|---|
| 214,996 | 5/1879 | Doane | 135/1 D |
| 645,890 | 3/1900 | Conrad | 135/DIG. 8 |
| 1,249,883 | 12/1917 | Baldwin | 135/1 D |
| 2,670,818 | 3/1954 | Hacker | 135/4 R |
| 3,226,727 | 12/1965 | Frey | 52/745 |
| 3,260,028 | 7/1966 | Fraser | 52/745 |

FOREIGN PATENTS OR APPLICATIONS

| | | | |
|---|---|---|---|
| 1,126,780 | 9/1968 | United Kingdom | 52/745 |

*Primary Examiner*—C. W. Lanham
*Assistant Examiner*—Joseph A. Walkowski
*Attorney, Agent, or Firm*—Joseph A. Geiger

[57] ABSTRACT

A method of mounting a natural draft cooling tower having a tower mantle suspended on a central support projecting beyond the upper rim of the mantle which is clamped and tightened between a pressure ring at the upper rim of the mantle and a foundation. In order to mount the cooling tower mantle, the pressure ring lying on the ground and coaxially surrounding the central support is suspended on a lifting ring by means of a plurality of supporting cables exceeding in length the radius of the pressure ring. This lifting ring is guided on the central support, suspended on a plurality of pulling elements which are lifted by at least one lifting device detachably connected to the central support, as a mantle section corresponding to the advance of the lifting device is displayed. After the lower rim of the cooling tower mantle has been connected to the foundation, the mantle is tightened by the lifting device. By attaching the lifting ring to the central support, the cooling tower mantle is maintained in its pre-stressed position.

9 Claims, 3 Drawing Figures

METHOD OF MOUNTING A NATURAL DRAFT COOLING TOWER

BACKGROUND OF THE INVENTION

1. Field of the Invention

The present invention relates to a method of mounting a cooling tower with a tower mantle which is suspended on a central support that projects beyond the upper edge of the mantle and which is vertically pre-stressed between a pressure ring at the upper edge of the mantle and a foundation.

2. Description of the Prior Art

In addition to the well-known cooling towers which are erected in the form of a steel framework construction, or built of concrete by using a slip form, cooling towers of light construction have become known which comprise a central support and a cooling tower mantle suspended on said central support. The cooling tower mantle is at its upper edge provided with a pressure ring on which it is suspended on a central support by means of cables, the central support projecting beyond the upper edge of the cooling tower mantle. In order to assure the necessary stiffness, the cooling tower mantle is stretched and pre-stressed between the pressure ring and a foundation.

According to a known embodiment, the cooling tower mantle comprises coextensive cable grids formed by a plurality of cables intersecting each other and of a cover connected to said lattice work.

SUMMARY OF THE INVENTION

It is an object of the present invention to provide a method which will permit a safe mounting of a large cooling tower of the above mentioned type of light construction with a minimum of material and in a minimum of time.

Accordingly, the present invention suggests a method of mounting a cooling tower mantle which is suspended on a central support projecting beyond the upper edge of the mantle and according to which the cooling tower mantle is stretched and tightened between a pressure ring at the upper edge of the cooling tower mantle and a foundation, the method characterized primarily in that the pressure ring lying on the ground and coaxially surrounding the central support is suspended on a lifting ring by means of a plurality of supporting cables having a length greater than the radius of the pressure ring, the lifting ring being guided on the central support and lifted by at least one lifting device connected to the central support, using a plurality of pulling elements. Simultaneously, a mantle section, corresponding in height to the lifting advance, is established. The method is further characterized in that the cooling tower mantle, after its lower edge has been connected to the foundation, is pre-stressed by means of the lifting device, and the lifting ring is held in this pre-stressing condition by attaching it to the central support.

In one mode of performing the invention, the pressure ring is connected to one end of a series of cables arranged in coextensive cable grids, which cables are connected to each other at their points of intersection during the lifting operation and after tensioning are provided with cover panels forming a mantle.

According to another mode of performing the invention, the pressure ring is connected to the upper edge of an annular shell which is adapted to sustain the tensions and simultaneously forms a portion of the tower mantle.

Independently of the design of the cooling tower mantle, it is suggested according to a further development of the method of the invention to move the lifting device stepwise upwardly ahead of the lifting ring on the central support, the lifting device being preferably formed by a plurality of hydraulically operated presses.

The method according to the present invention has the advantage of necessitating as special mounting implements only the hydraulic lifting device and the pulling elements because all other elements necessary for the mounting remain has parts in the cooling tower. As pulling elements, are employed reusable cables. The lifting device which consists preferably of hydraulic presses can likewise be used again for other purposes. Thus, an economic and safe method for mounting the cooling tower mantle on the central support is obtained while the mounting devices are simultaneously used for creating the necessary tension in the cooling tower mantle.

BRIEF DESCRIPTION OF THE DRAWINGS

Further special features and advantages of the invention will become apparent from the description following below, when taken together with the accompanying drawings which illustrate, by way of example, a mode of performing the invention, represented in the various figures as follows.

DESCRIPTION OF THE PREFERRED MODE OF PERFORMING THE INVENTION

Figure 1:
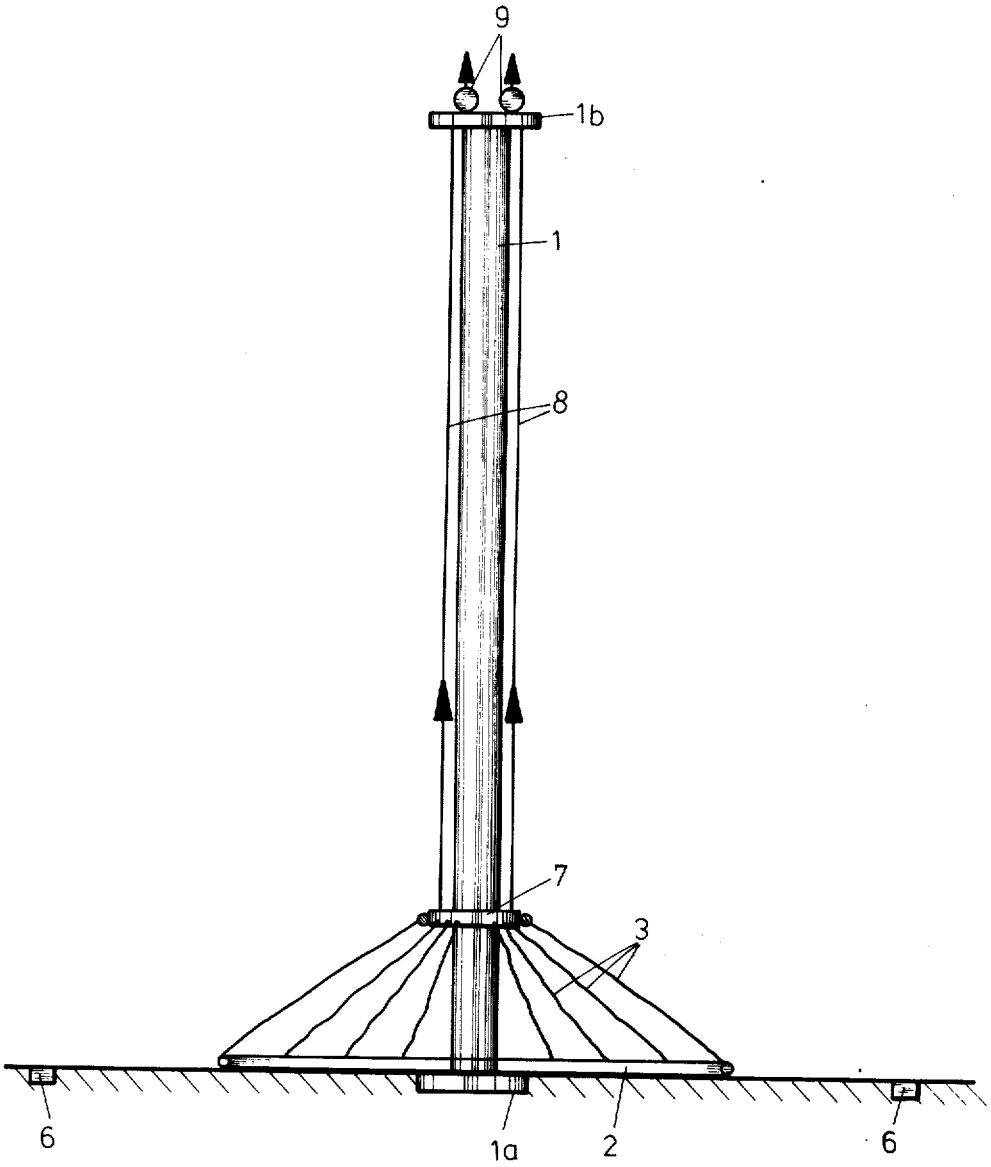
FIG. 1 illustrates an initial stage of the mounting method, the pressure ring still resting on the ground.

Referring to the drawings, there is shown a cooling tower which is to be mounted in accordance with the method of the present invention, the tower being a lightweight structure, having a central support 1 which is the first part to be erected on a support foundation 1*a* and which, at its upper end, has a supporting flange 1*b*. The cooling tower mantle has its upper rim provided with a pressure ring 2, suspended on the central support 1 by means of supporting cables 3 which are attached to the central support 1, said central support 1 projecting beyond the upper rim or edge of the cooling tower mantle, when the latter is fully extended.

In the example illustrated in the drawing, the cooling tower mantle consists of a composite cable network 4 which is formed by three intersecting cable grids, forming a hyperbolic cable structure with triangular meshes. The cable grids consist of a set of inclined diagonal cables 4*a* ascending in the right-hand direction, a set of inclined diagonal cables 4*b* ascending in a left-hand direction, and a set of meridian cables 4*c* ascending in vertical planes. These cables are clamped together at the points where they intersect each other. The resulting composite cable network 4 has the properties of a shear-resistant shell having connected thereto an air-tight skin or mantle 5. The skin 5 may be of one piece, manufactured, for instance, of sheet metal or synthetic plastic material, or it may be composed of a plurality of panels of synthetic plastic material, sheet metal, or asbestos.

In order to mount the cooling tower mantle, supporting cables 3 are connected with their lower ends to the pressure ring 2, and with their upper ends to a lifting ring 7 which is guided on the already erected central support 1. A plurality of pulling elements 8 serve to raise this assembly by means of at least one lifting device 9 connected to the upper end of the central support 1. As pulling elements are preferably used heavy steel cables. The lifting device 9 preferably consists of a plurality of hydraulically operated special lifting presses.

Prior to raising the cooling tower mantle, the cable network 4 is assembled on the ground in such a way that its pressure ring 2 coaxially surrounds the central support 1. Thereupon the supporting cables are connected between the pressure ring 2 and the lifting ring 7. Subsequently, the lifting ring 7, suspended on the pulling elements 8, is raised by means of the lifting device 9, in a continuous or intermitted operation.

Figure 2:
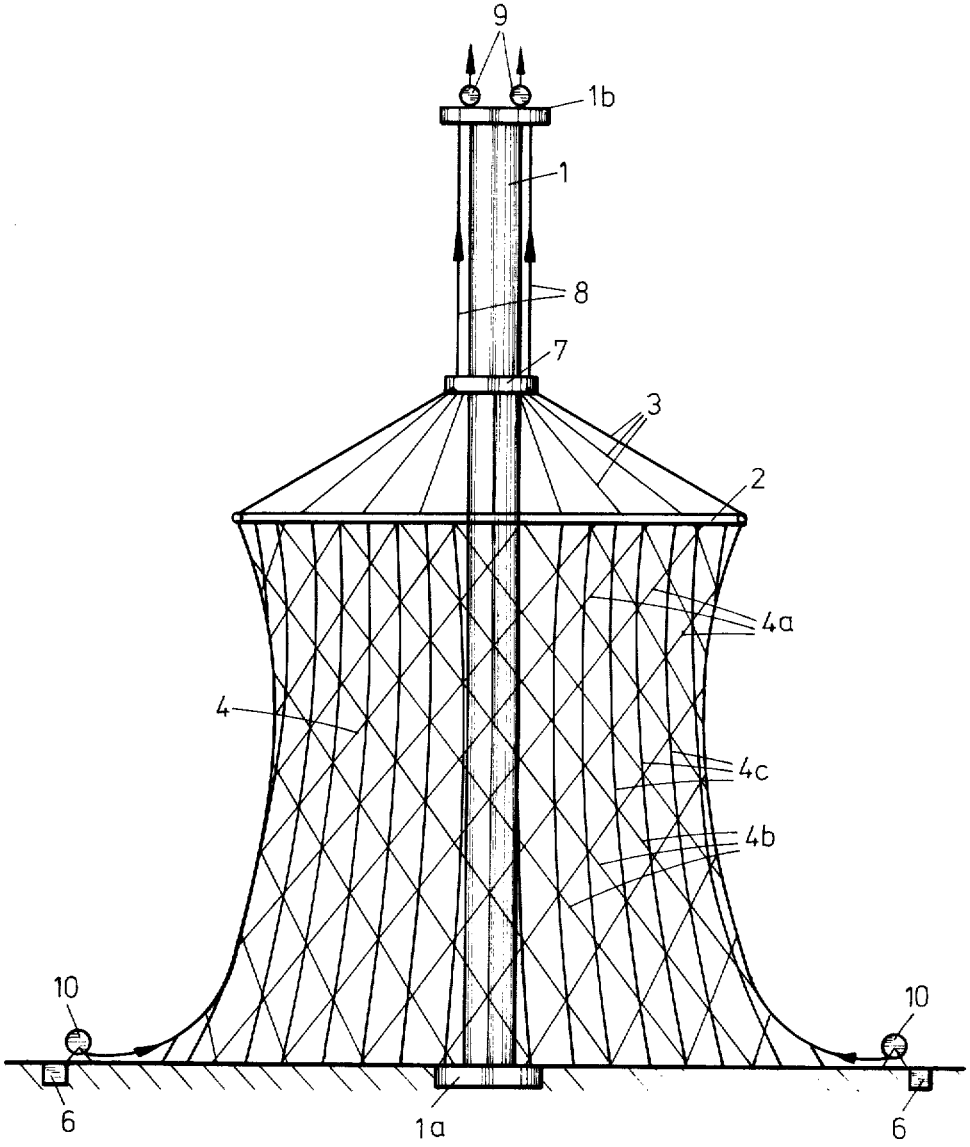
FIG. 2 shows an intermediate stage of the mounting method, the pressure ring having been raised to about twothirds of the height of the central support.
Figure 3:
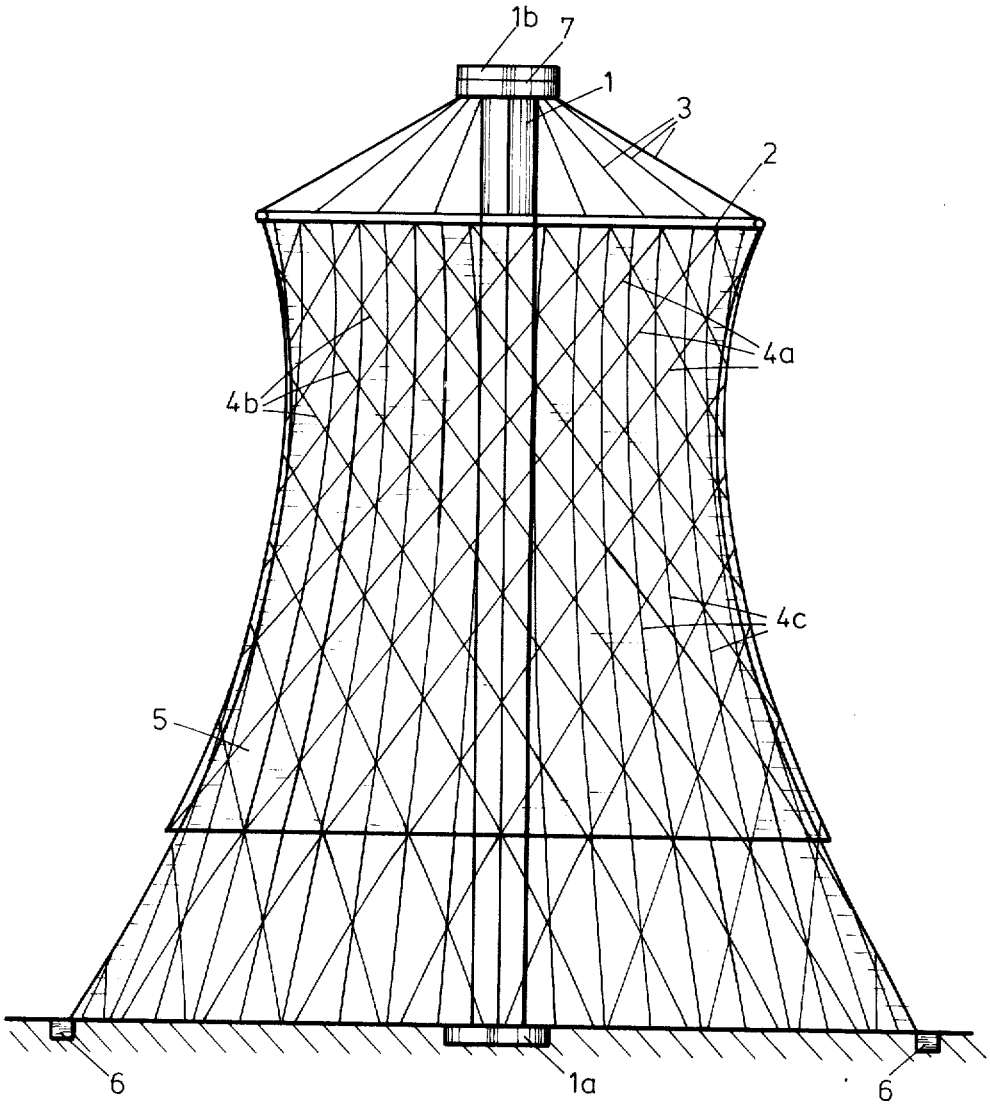
FIG. 3 shows a completely mounted natural draft cooling tower in a somewhat schematically simplified view.

The upward motion of the lifting ring 7 and of the pressure ring 2 results in a corresponding advance of the cooling tower mantle, so that a mantle section to the lifting advance is simultaneously. Depending on the type of cooling tower mantle to be assembled, the latter may be assembled during the lifting operation, for instance when large cooling towers are involved. FIG. 2 shows that when the cable network 4 illustrated in the drawing is deployed, the diagonal cables 4*a* and 4*b* as well as the meridian cables 4*c* are released from cable drums 10 during the lifting operation. In order to obtain the desired shear-resistant shell structure, it is necessary to connect the cables 4*a*–4*c* at their points of intersection.

Just before the cooling tower mantle reaches its fully raised position, its lower rim is connected to the foundation 6. The last portion of the upward advance of the lifting ring 7 thus serves simultaneously to tension and pre-stress the cable network of the cooling tower mantle. By locating and fastening the lifting ring 7 on the supporting flange 1*b* of the central support 1, the generated tension will be maintained. The completed cooling tower mantle with its cover 5 has the properties of a shear-resistant structural shell.

Following mounting of the cooling tower the mounting devices, consisting essentially of the pulling elements 8 and the lifting devices 9, are removed pulling elements 8 as well as the lifting device 9 are for the most part reusable general-purpose implements, so that for the method according to the present invention no special devices are necessary which become useless after the job is completed.

It is, of course, to be understood that the present invention is not limited to the specific showing in the drawings, but also comprises any modifications falling within the scope of the appended claims.

What we claim is:

1. A method of assembling and erecting a cooling tower, especially a natural draft cooling tower of great height and diameter which has a light-weight mantle constituted by a skin attached to multiple cable grids and extending between a single central support column and a foundation, the assembly method comprising the steps of:

constructing the central support column on a foundation as a free-standing structure to a height in excess of the intended height of the tower mantle;

assembling on the ground, concentrically spaced from the central support column, a pressure ring constituting the upper rim of the tower mantle;

positioning a lifting ring near the foot of said column so as to surround the latter with little clearance;

attaching to the lifting ring a series of radially regularly spaced supporting cables connecting the lifting ring to the pressure ring for suspension of the latter from the former at a vertical distance substantially corresponding to the difference in height between the central support column and the tower mantle;

attaching to the pressure ring the ends of at least two series of cables in a pattern of intersecting cable grids, designed to extend diagonally downwardly between the pressure ring and the foundation, to form a hyperboloid-shaped, composite cable grid as part of the tower mantle;

advancing the lifting ring upwardly along the central support column, thereby raising the pressure ring which is connected thereto and extending the cable grids which are connected to the latter; and securing the lifting ring in relation to the central support column in the fully extended position of the tower mantle.

2. A cooling tower assembly method as defined in claim 1, wherein the step of vertically advancing the lifting ring includes the step of vertically pre-stressing the cable grids of the tower mantle, prior to securing the lifting ring in relation to the central support column.

3. A cooling tower assembly method as defined in claim 2, further comprising the steps of:

mounting a supporting flange on the upper end of the central support column;

extending a plurality of vertical lifting cables between the supporting flange and the lifting ring; and pulling on the lifting cables, in order to perform the step of upwardly advancing the lifting ring as well as the pressure ring and mantle that are attached thereto.

4. A cooling tower assembly method as defined in claim 3, wherein the step of pulling on the lifting cables involves the use of hoisting means attached to the lifting ring, which hoisting means is capable of advancing the lifting ring upwardly against the lifting cables, the latter being fixedly attached to the supporting flange.

5. A cooling tower assembly method as defined in claim 3, wherein the step of pulling on the lifting cables involves the use of stationary hoisting means mounted on top of the supporting flange, which hoisting means is capable of advancing the lifting cables upwardly.

6. A cooling tower assembly method as defined in claim 5, wherein the step of securing the lifting ring involves permanently attaching the latter to the supporting ring on top of the central support column.

7. A cooling tower assembly method as defined in claim 1, wherein the step of upwardly advancing the lifting ring involves making interruptions in said advance, during which corresponding vertical increments of the tower mantle are assembled.

8. A cooling tower assembly method as defined in claim 7, wherein said incremental assembly of the tower mantle includes the clamping together of intersecting cables of said cable grids, so as to form cable polygons, and the attachment of constituent panels of the tower mantle skin to said cable polygons.

9. A cooling tower assembly method as defined in claim 7, wherein said incremental assembly of the tower mantle includes the unwinding of the constituent cables of the cable grids from mobile cable winches.

* * * * *